United States Patent [19]

Yoshida et al.

[11] 4,288,975

[45] Sep. 15, 1981

[54] METHOD AND APPARATUS FOR STARTING A SPINNING MACHINE

[75] Inventors: Yoshiaki Yoshida; Osamu Suzuki, both of Ohbu; Keiji Onoue; Kazuo Seiki, both of Kariya, all of Japan

[73] Assignee: Kabushiki Kaisha Toyoda Jidoshokki Seisakusho, Kariya, Japan

[21] Appl. No.: 131,132

[22] Filed: Mar. 17, 1980

[30] Foreign Application Priority Data

Mar. 22, 1979 [JP] Japan ..... 54/32315

[51] Int. Cl.[3] ..... D01H 15/02; D01H 1/30

[52] U.S. Cl. ..... 57/263; 57/78; 57/58.89

[58] Field of Search ..... 57/78, 263, 92, 58.89, 57/264

[56] References Cited

U.S. PATENT DOCUMENTS

| | | | |
|---|---|---|---|
| 3,354,626 | 11/1967 | Cizek et al. | 57/78 |
| 3,791,128 | 2/1974 | Landwehrkamp et al. | 57/58.89 X |
| 3,892,062 | 7/1975 | Stahlecker et al. | 57/78 X |
| 3,939,638 | 2/1976 | Bruckert et al. | 57/58.89 X |
| 4,080,775 | 3/1978 | Stahlecker | 57/78 X |
| 4,172,357 | 10/1979 | Stahlecker et al. | 57/78 X |
| 4,178,749 | 12/1979 | Stahlecker et al. | 57/263 |

*Primary Examiner*—Donald Watkins
*Attorney, Agent, or Firm*—Haseltine & Lake

[57] ABSTRACT

According to this invention, a spinning rotor is increased in speed until it reaches a predetermined higher speed beyond a lower speed region and then decreased in speed until it falls within the lower speed region, in which a yarn ending is effected. Thereafter, the speed of the spinning rotor is increased to a normal spinning speed beyond the predetermined higher speed. During rotation of the spinning rotor at the predetermined higher speed, sufficient subatmospheric pressure is produced in the spinning rotor to stretch out the yarn end thereby to prevent the yarn end from being snarled. Also, during this higher speed rotation of the spinning rotor, sufficient fibers in the spinning rotor can be collected in a maximum diameter portion in the spinning rotor to be connected with the snarl-free yarn end in a favorable condition. The period of time, during which the speed of the spinning rotor is decreased from the predetermined higher speed and falls within the lower speed region, is relatively short being in the order of a few or several seconds. Therefore, it will be understood that there is no fear that both the yarn end and the remaining fibers are restored to their initial state during that period of time.

5 Claims, 3 Drawing Figures

METHOD AND APPARATUS FOR STARTING A SPINNING MACHINE

BACKGROUND OF THE INVENTION

This invention relates to a method and apparatus for starting a spinning machine, in which a yarn ending is carried out onto a spinning rotor before the speed of the latter reaches its steady speed.

Generally, in an open end spinning machine such, for example, as described in U.S. Pat. No. 3,354,626, each spinning unit includes means for feeding individually opened fibers into a spinning rotor, in which subatmospheric pressure is produced by rotation thereof. The opened fibers are formed into a yarn in the spinning rotor. The yarn is transported from the spinning rotor by take-up means including a yarn take-up tube and yarn take-up rollers and wound on a bobbin by winding means. Also, in the above open end spinning machine, each of the fiber feeding means, yarn take-up means and yarn winding means is mounted on a separate driving shaft and a single motor drives these separate driving shafts through a rotation transmission mechanism including trains of gears. This motor also drives an endless belt, which is in frictional contact with spindles of the spinning rotors to rotate the same.

When the spinning machine is stopped, the fiber feeding means, yarn take-up means, yarn widning means and endless belt are simultaneously stopped, which causes breaking of the yarn simultaneously in all the spinning rotors. At that time, the yarn end remains in the yarn take-up tube, i.e., in the region which undergoes the suction effect of the subatmospheric pressure produced in the spinning rotor when the spinning machine is in operation, and the fibers remain in the spinning rotor.

To start the spinning machine, rotation of all spinning rotors is simultaneously started, whereupon the yarn take-up rollers are rotated in a reverse direction to push the yarn ends from the take-up tubes into the spinning rotors and the remaining fibers are re-collected in fiber collecting grooves formed in the spinning rotors and twisted into the yarn ends. Thus, a yarn ending is completed in each spinning rotor. In order to facilitate the yarn ending by increasing a time tolerance for a proper timing of the rearward feeding of the yarn end in reference to the supply of new fibers, the yarn ending has been effected while the speed of the spinning rotor is still in the lower level, in which the speed is lower than the steady speed of the spinning rotor during the normal spinning operation.

With this starting method, the remianing fibers in the spinning rotor are not satisfactorily collected because of the lower speed of the spinning rotor during the yarn ending operation and therefore the yarn end can not be properly connected with the collected fibers, resulting in a reduced success rate of the yarn ending and production of an irregular yarn. Especially, in the case where the spinning rotor is of the air self-discharging type in which air is discharged from the interior of the spinning rotor through openings formed in the bottom thereof thereby to provide a subatmospheric pressure in the spinning rotor, the amount of air discharged from the latter is greatly reduced during rotation of the spinning rotor at a lower speed so that the yarn end in the yarn take-up tube communicating with the spinning rotor can not be stretched out sufficiently to prevent the occurrence of snarls at the yarn end. The snarls of the yarn end have an adverse affect on the rearward feeding of the yarn end, resulting in a reduced success rate of the yarn ending.

It is therefore a principal object of this invention to provide a method and apparatus for starting a spinning machine, which can remove the above-discussed disadvantages of the prior art.

SUMMARY OF THE INVENTION

According to this invention, a spinning rotor is increased in speed until it reaches a predetermined higher speed beyond a lower speed region and is then decreased in speed until it falls within the lower speed region, in which yarn ending is effected. Thereafter, the speed of the spinning rotor is increased to a normal spinning speed beyond the predetermined higher speed. During rotation of the spinning rotor at the predetermined higher speed, sufficient subatmospheric pressure is produced in the spinning rotor to stretch out the yarn end thereby to prevent the yarn end from being snarled. Also, during this higher speed rotation of the spinning rotor, sufficient fibers in the spinning rotor can be collected in a maximum diameter portion in the spinning rotor to be connected with the snarl-free yarn end in a favourable condition. The period of time during which the speed of the spinning rotor is decreased from the predetermined higher speed and falls within the lower speed region, is relatively short, being in the order of a few or several seconds. Therefore, it will be understood that there is no fear that both the yarn end and the remaining fibers are restored to their initial state during that period of time. This enables the yarn ending to be performed with no disadvantages.

BRIEF DESCRIPTION OF THE DRAWINGS

This invention will become more readily understood from the following description of the preferred embodiment shown, by way of example only, in the accompanying drawings, wherein.

DESCRIPTION OF THE PREFERRED EMBODIMENT

Figure 1:
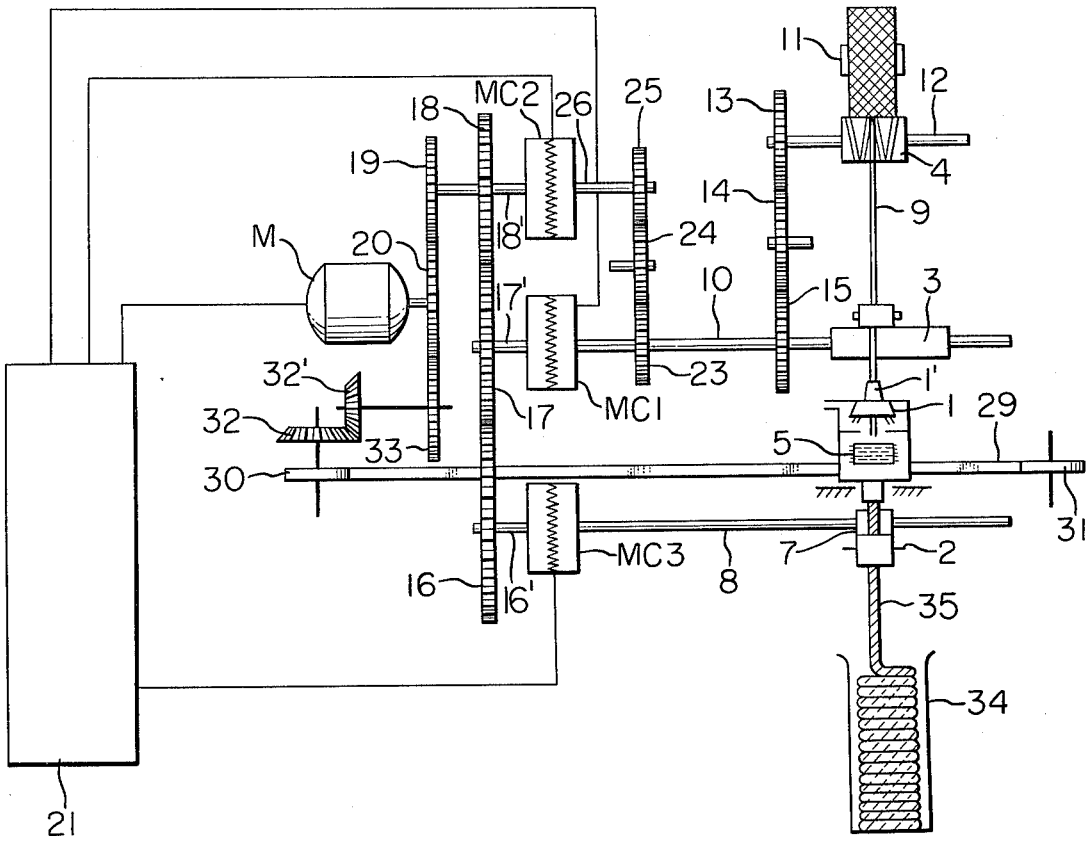
FIG. 1 is a fragmentary schematic view showing a portion of a prior art spinning machine to which this invention is applicable.

Referring to FIG. 1, there is shown a rotation transmission mechanism of a prior open end spinning machine similar to that described in U.S. Pat. No. 3,354,626 and this invention can be applied to such a spinning machine. Although only one spinning unit is shown in FIG. 1, the spinning machine normally comprises a number of spinning units arranged on each side of the spinning machine, and to start the spinning machine yarn endings are simultaneously effected in all the spinning units.

Each spinning unit comprises a spinning rotor 1 into which opened fibers are supplied and formed into a yarn 9, means for feeding a sliver or roving 35 from a can 34, means for opening the sliver 35 into the individual fibers and supplying them into the spinning rotor 1, means for taking up the yarn 9, and a winding roller 4 for winding the yarn 9 onto a bobbin 11. The feeding means comprises lower and upper feeding rollers 2 and 7 forming a nip therebetween, through which the sliver 35 is fed. The fiber opening and supplying means comprises a combing roller 5 of the wall known type. The take-up means 3 includes a lower take-up roller and an upper take-up roller driven by the lower roller. The spinning rotor 1 may be of either the self-discharge type, wherein air in the interior of the spinning rotor is discharged through not shown openings provided in the bottom of the spinning rotor by rotation of the latter itself, or the forced discharge type, wherein air in the interior of the spinning rotor is discharged through a not shown intake system disposed outside of the spinning rotor. In any case, a subatmospheric pressure is produced in the interior of the spinning rotor 1 during rotation thereof and the individual fibers opened by the combing roller 5 are drawn into the interior of the spinning rotor 1.

The take-up means includes a yarn take-up tube 1' disposed between the take-up roller 3 and the spinning rotor 1 so as to be in air communication with the latter. As well known, the individual fibers are twisted into the end of the yarn in the spinning rotor 1 and the resultant yarn 9 is taken up from the spinning rotor 1 through the take-up tube 1' by the take-up rollers 3. Although only one pair of take-up rollers 3 is shown, all the lower take-up rollers in the number of spinning units are mounted on a common driving shaft 10 mounted for rotation in a not shown frame of the spinning machine. The winding roller 4 provided with crossing grooves is in driving relationship with the bobbin 11 to wind a package thereon in a cross winding manner. All the widing rollers 4 of the spinning units are attached to a driving shaft 12 mounted for rotation on the spinning machine's frame.

The driving shaft 12 is rotated through a train of gears 13, 14 and 15 by the driving shaft 10 in the same direction as the shaft 10.

Also, all the sliver feed rollers 7 are mounted on a common driving shaft 8 connected through a sliver feed electromagnetic clutch MC3 (hereinafter referred to as the "feed clutch") with a shaft 16' supporting a gear 16, which is driven through a train of gears 17, 18, 19 and 20 by an electric motor M. The shaft 10 for driving the take-up rollers 3 is connected through an electromagnetic clutch MC1 with a shaft 17' supporting the gear 17. The clutch MC1 is hereinafter referred to as the "reverse clutch" because the yarn is fed in a reverse direction when the clutch MC1 is in engagement. To rotate the shaft 10 in a forward direction, the gear 18 supported by a shaft 18' is connected through an electromagnetic clutch MC2 and a train of gears 23, 24 and 25 with the shaft 10. The gear 23 is mounted on the shaft 10 so as to be positioned between the reverse clutch MC1 and the gear 15. The gear 23 meshes with the intermediate gear 24, which meshes in turn with the gear 25 supported by a shaft 26. The shaft 26 is connected to a driven member of the clutch MC2. The clutch MC2 is hereinafter referred to as the "forward clutch", because the yarn is fed in forward direction when it is in engagement.

Mounted around a pair of pulleys 30 and 31 is an endless belt 29, which is in driving relationship with all the spinning rotors 1 in a conventional manner so that all the spinning rotors 1 are simultaneously rotated in the same direction. The pulley 30 is driven through a train of gears 32, 32', 33 and 20 by the motor M.

Therefore, it will be understood that in this embodiment all the spinning units are driven by the single motor M and their operation is controlled by controlling the motor M, forward clutch MC2, reverse clutch MC1 and feed clutch MC3 with a control apparatus 21 according to this invention. The electric circuit of the control apparatus 21 is shown in FIG. 3.

Figure 2:
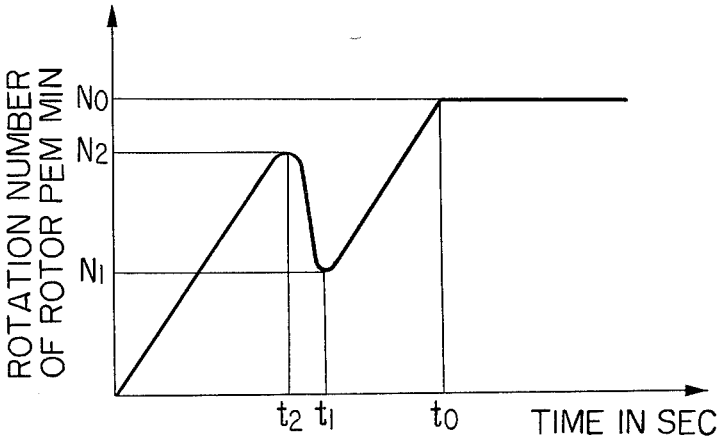
FIG. 2 is a graph explaining the time and rate of rotation relationships of a spinning rotor according to an operating method of this invention.

According to this invention, the control apparatus 21 is adapted to control the elements M and MC1 to MC3 so that each spinning rotor 1 starts to rotate in the time and rate of rotation relationships shown in FIG. 2. That is, when it is necessary to perform the yarn ending in each spinning rotor 1 to start the spinning machine, operation of the motor M is started in the condition where each of the reverse clutch MC1, forward clutch MC2, and feed clutch MC3 is disengaged, thereby causing only the spinning rotors 1 to start rotation. The rate of rotation of each spinning rotor 1 gradually increases an reaches a predetermined higher value $N_2$ relatively close to a steady value $N_0$, at which the spinning rotor 1 is rotating during the normal spinning operation. Until the rate of rotation of the spinning rotor 1 reaches the predetermined value $N_2$, the yarn end present in the take-up tube 1' is stretched out sufficiently to prevent the yarn end from being snarled and the remaining fibers in the spinning rotor 1 are collected in a favourable state. Then, a supply of electricity to the motor M is temporarily interrupted to reduce the rate of rotation of the spinning rotor 1 from the higher value $N_2$ to a lower value $N_1$, which is sufficient to carry out the yarn ending. At the time when the speed reduction to the lower level $N_1$, is attained, the motor M is energized again and the reverse clutch MC1 is energized to feed the yarn end in a reverse direction into the spinning rotor 1, in which the yarn end is connected to the satisfactorily collected fibers remaining therein. Thereafter, in proper timed relation with the reverse feed of the yarn end, the reverse clutch MC1 is deenergized and both the forward clutch MC2 and feed clutch MC3 are energized so as to initiate the normal spinning operation in each spinning unit.

The operation of this control apparatus 21 will be described below in conjunction with the electric circuit shown in FIG. 3.

Figure 3:
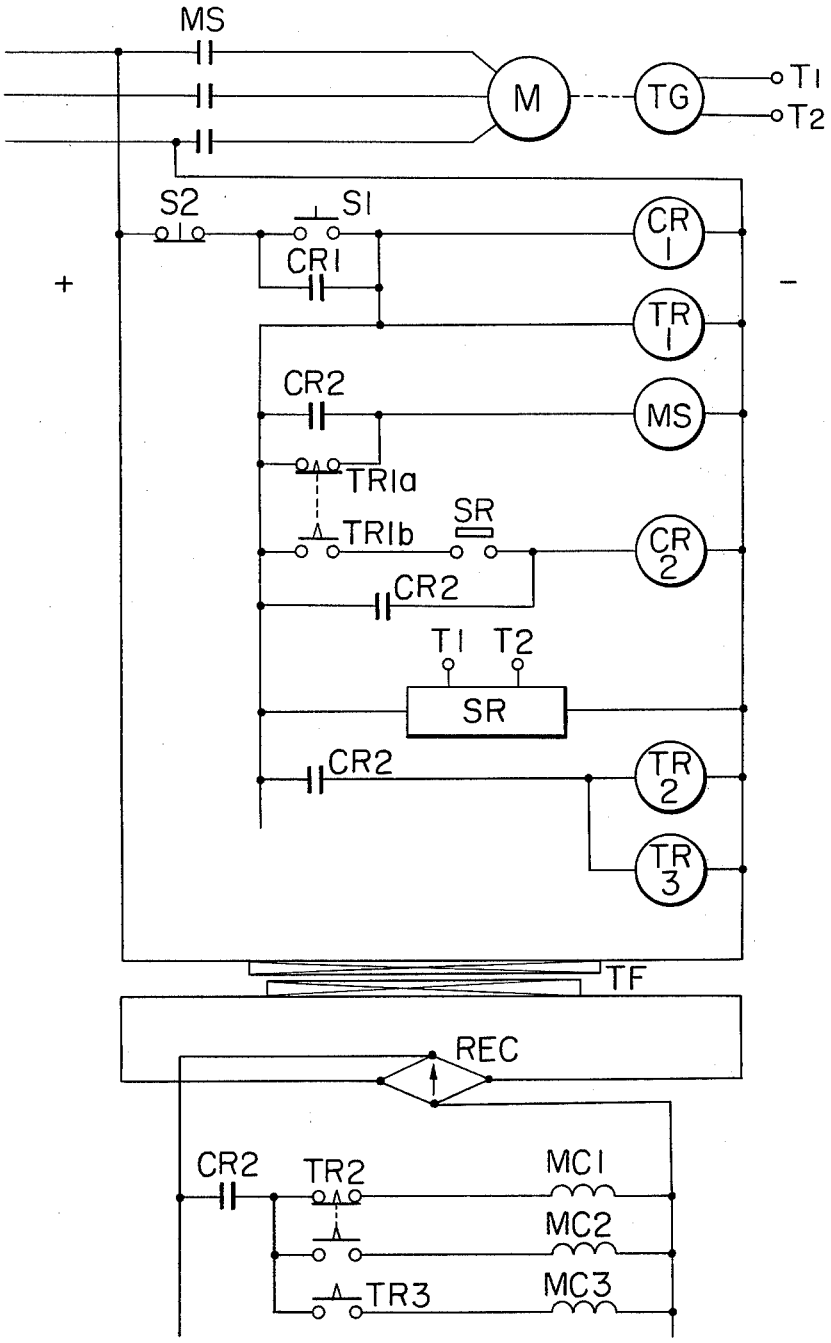
FIG. 3 is a view illustrating an electric circuit of an operating apparatus according to this invention.

Between vertical lines labelled respectively with a plus symbol (+) and a minus symbol (−) to represent the positive and negative sides of a source of current, various elements composing the control apparatus 21 according to this invention are connected in a wiring manner shown in FIG. 3. A start pushbutton S1 is serially interposed between a normally closed stop pushbutton S2 and a control relay CR1. The start pushbutton S1 is switched on by an operator to start operation of the spinning machine. At that time, the current flows through the stop pushbutton S2 and the start pushbutton S1 to the relay CR1 and a timer relay or time delay relay TR1 connected in parallel to the relay CR1, and through normally closed contacts TR1a of the timer TR1 to a motor switch relay MS connected in parallel to the timer TR1. Therefore, normally open contacts of the relay CR1 are closed to maintain the relay CR1 and timer TR1 in the energized state. Thus, the timer TR1 starts to count to a set time $t_2$ (FIG. 2), at which the rate of rotation of the spinning rotor 1 reaches the predetermined higher level $N_2$. Simultaneously with the start of operation of the timer TR1, the relay MS is energized to close contacts thereof, whereby rotation of the motor M is started.

The motor M is associated with the tachometer generator TG having terminals T1 and T2, across which a device SR for detecting a rotation speed of the motor M is connected. The detecting device SR is designed to turn on when the motor's speed increases beyond a specific value at which the rate of rotation of the spinning rotor 1 reaches the lower level $N_1$ and to turn off when the motor's speed decreases below the aforementioned specific value. However, it will be understood that the detecting device SR becomes operative simultaneously with the switching on of the start switch S1.

When the set time $t_2$ lapses after the start of the motor M and accordingly the rate of rotation of the spinning rotor 1 reaches the predetermined higher level $N_2$, the timer TR1 causes the normally closed contacts TR1a to be opened and the normally opened contacts TR1b to be closed. As a result, the relay MS is deenergized to open the contacts thereof, whereby the supply of current to the motor M is temporarily interrupted. Until this interruption, the yarn end in the take-up tube 1' (FIG. 1) can be maintained in the stretched state by the subatmospheric pressure produced in the spinning rotor 1 rotating at the speed of $N_2$ r.p.m. in excess of $N_1$ r.p.m., which pressure is sufficient to prevent the yarn end from being snarled even after the temporary stop of the motor M is ceased. Also, the fibers remaining in the spinning rotor 1 can be collected in a favourable stage by the action of greater centrifugal force resulting from the spinning rotor's rotation on at the greater speed of $N_2$ r.p.m.

The temporary interruption of current supply to the motor M causes the rate of rotation of the spinning rotor 1 to be reduced to $N_1$ r.p.m., which is favourable to the yarn ending since sufficient time is available for connecting the yarn end with the remaining fibers. At that time, the detecting device SR causes the switch thereof interposed between a control relay CR2 and the normally open contacts TR1b of the timer TR1 to be switched on. Therefore, the relay MS is energized again and the motor M is started again. At the same time, the reverse clutch MC1 is energized through normally closed contacts of a timer relay TR2 for setting a time at which the forward clutch MC2 is to be energized. When the reverse clutch MC1 is on, as shown in FIG. 1, the rotation of the motor M is transmitted through the reverse clutch MC1 to the shaft 10 and hence through the gear train 15, 14 and 13 to the shaft 12, whereby both the take-up rollers 3 and winding rollers 4 are rotated in reverse direction in which each yarn end is fed into the respective spinning rotor 1. The period of time ($t_1$–$t_2$), during which the rate of rotation of the spinning rotor 1 is reduced from $N_2$ to $N_1$, is relatively short, normally being in the order of a few or several seconds (at most about 5 seconds) so that there is no fear that during this time period the yarn end will be snarled and the once collected fibers restored to the initial loosened state. Thus, the yarn end can be fed into the spinning rotor smoothly and advantageously connected with the remaining fibers preliminarily and sufficiently collected in the spinning rotor 1 once rotated at the higher speed of $N_2$ r.p.m. in excess of $N_1$ r.p.m.

Moreover, simultaneously with the restart of operation of the motor M, both the timer relays TR2 and TR3 are energized by the closed contacts of the relay CR2. Set times of operation controlled by the timers TR2 and TR3 are so selected that the taking up of the pieced yarn from the interior of the spinning rotor can be effected in good timed relation as well known to those skilled in the art with the fedding of the new fibers into the spinning rotor. When the timer TR2 counts up the set time, the reverse clutch MC1 is deenergized while the forward clutch MC2 is energized, and when the timer TR3 counts up the set time, the feed clutch MC3 is energized. Therefore, as shown in FIG. 1, the rotation of the motor M is transmitted through the forward clutch MC2 and the gear train 25, 24 and 23 to the shaft 10 and hence through the gear train 15, 14 and 13 to the shaft 12, thereby rotating both the take-up rollers 3 and the winding rollers 4 in the forward direction, i.e., in the yarn winding up direction. Also, the rotation of the motor M is transmitted through the feed clutch MC3 to the shaft 8, thereby rotating the sliver feed rollers 7 to supply the opened fibers into the spinning rotor 1.

Although a single preferred embodiment has been described above, it will be readily understood by those skilled in the art that this invention is applicable to other open end spinning machines having different constructions. For example, the spinning machine may employ a single electromagnetic clutch in liew of the reverse and forward clutches MC1 and MC2. Also, the spinning rotors may be driven by a separate motor independent of the motor M, and the feeding of the yarn end in the reverse direction may be carried out by storing up an additional length of yarn between the take-up roller 3 and the take-up tube 1 when the spinning machine is stopped and releasing the stored yarn when it is necessary to feed the yarn end in the reverse direction, whereupon the released yarn is sucked into the spinning rotor by the subatmospheric pressure produced therein.

It is to be noted that whereas the rate of rotation of the spinning rotor during the normal spinning operation is for example about 60,000 r.p.m., the yarn ending is generally carried out while the spinning rotor is rotating at the speed of about 30,000 to 40,000 r.p.m. In this case, a rate of rotation $N_2$ of about 45,000 to 55,000 r.p.m. is satisfactory to the preliminary collection of the individual fibers. Moreover, where the rate of rotation of the spinning rotor during the normal spinning operation is for example about 80,000 r.p.m., the yarn ending is generally carried out while the spinning rotor is rotating at a speed of about 55,000 to 60,000 r.p.m. In this case, a rate of rotation $N_2$ of about 65,000~70,000 r.p.m. is satisfactory.

Furthermore, in the open end spinning machine of the type shown in FIG. 1, when a yarn breakage occurs in any spinning unit during a spinning operation, a yarn ending has to be performed in the associated spinning rotor. In this case, it is possible to start operation of the spinning rotor according to the method of this invention.

What we claim is:

1. A method for starting-up an open-end spinning machine for yarn ending, comprising:

(a) increasing the speed of the spinning rotor from a stopped position to a predetermined speed approaching its operating speed;

(b) momentarily decreasing the speed of the spinning rotor to that of a substantially lower speed in order to effect the yarn ending;

(c) increasing the speed of the spinning rotor to its normal operating speed while the yarn-feed direction is reversed for yarn ending; and (d) again reversing the yarn-feed direction to return it to its normal operating direction thereby initiating the feed of the sliver.

2. An apparatus for starting-up and open-end spinning machine for yarn ending, comprising:

(a) a driving motor;

(b) means from the motor for rotating a spinning rotor;

(c) clutch means controlling the direction of the yarn in the spinning rotor;

(d) clutch means controlling a motor driven sliver-feed to the spinning rotor;

(e) means driven by the motor for yarn take-up; and (f) a control means wherein the yarn ending is accomplished by spinning the rotor to a pre-determined speed level approaching its operating level, decreasing the speed of the spinning rotor to a substantially lower speed while increasing the rotor speed to its normal speed, then feeding the yarn in a reverse direction into the spinning rotor, and reversing the yarn direction to its normal operating direction thereby initiating the feed of the sliver to the spinning rotor.

3. The apparatus as claimed in claim 2, wherein the speed reducing means comprises means for temporarily interrupting a supply of current to the driving motor.

4. The apparatus as claimed in claim 2, wherein the control means comprises a device for detecting the rate of rotation of the spinning rotor, the detecting device being connected across terminals of a tachometer generator associated with the driving motor and generating a signal at a predetermined speed to temporarily interrupt the flow of current to the motor so that the speed of the spinning motor can be substantially reduced.

5. The apparatus as claimed in claim 2, wherein the control means comprises a detecting device for receiving a signal and subsequent to the speed reduction of the spinning rotor provides the driving motor with the current supply.

* * * * *